United States Patent [19]

Morel

[11] Patent Number: 4,854,758

[45] Date of Patent: Aug. 8, 1989

[54] RETRACTABLE APPLICATOR DEVICE FOR NAIL VARNISHES WITH FLOW CONTROL

[75] Inventor: Simone Morel, Montmirail, France

[73] Assignee: Societe de Conseils et D'Etudes des Emballages SCEE, Dammartin en Goele, France

[21] Appl. No.: 253,901

[22] Filed: Oct. 6, 1988

Related U.S. Application Data

[63] Continuation of Ser. No. 26,508, Mar. 17, 1987, abandoned.

[30] Foreign Application Priority Data

Mar. 17, 1986 [FR] France ..... 86 03752

[51] Int. Cl.[4] ..... A45D 34/00

[52] U.S. Cl. ..... 401/116; 401/205; 401/277; 401/199

[58] Field of Search ..... 401/101, 115, 116, 205, 401/274, 277, 199

[56] References Cited

U.S. PATENT DOCUMENTS

| | | | |
|---|---|---|---|
| 2,164,004 | 6/1939 | Wright | 401/277 |
| 2,618,416 | 11/1952 | Thorpe | 401/277 X |
| 2,623,231 | 12/1952 | Gatenstein | 401/116 |
| 2,629,123 | 2/1953 | Mahruki | 401/116 |
| 2,932,046 | 4/1960 | Skolnikoff | 401/274 X |
| 3,127,630 | 4/1964 | La Mura | 401/115 |
| 4,063,829 | 12/1977 | La Mura | 401/274 X |

FOREIGN PATENT DOCUMENTS

| | | | |
|---|---|---|---|
| 0170000 | 2/1986 | European Pat. Off. . | |
| 321326 | 5/1920 | Fed. Rep. of Germany | 401/116 |
| 2159543 | 11/1971 | France | 401/274 |
| 509270 | 6/1955 | Italy | 401/116 |
| 2071488 | 9/1981 | United Kingdom | 401/274 |

*Primary Examiner*—Steven A. Bratlie

*Attorney, Agent, or Firm*—Browdy and Neimark

[57] ABSTRACT

The application device is placed in a container having a wick applicator, wherein a neck of the container is provided with a socket-shaped support piece having a bottom portion and at least one port adjacent the bottom portion, opening and tight closing of the at least one port being controlled by a guidingly and drivingly controllable sliding sleeve forming a slide valve containing a wick protruding above an upper end of the sleeve.

10 Claims, 1 Drawing Sheet

RETRACTABLE APPLICATOR DEVICE FOR NAIL VARNISHES WITH FLOW CONTROL

This application is a continuation of application Ser. No. 26,508, filed Mar. 17, 1987, now abandoned.

BACKGROUND OF THE INVENTION

The present invention relates to a new applicator device for nail varnishes and similar liquid products.

Nail varnishes are most often applied by using a brush fixed inside the closing cap of a bottle or flask containing the varnish.

Such an arrangement has several disadvantages.

The flasks containing the varnishes are often unstable, and there is therefore a risk that they will fall by accident when they are open.

On the other hand, when the applicator brush is used, the flask is opened to the atmosphere, which causes an evaporation of the very volatile solvent maintaining the varnish in an acceptable fluidity state for being spread on a nail.

BRIEF DESCRIPTION OF KNOWN PRIOR ART

In order to remedy the hereabove disadvantages, it has been proposed for example in European patent specification No 0 170 000, to provide new compositions of nail varnishes which are much more fluid than those commonly used and to distribute these varnishes by means of a porous wick which can be covered by a closing cap.

However, the arrangement disclosed in European Patent specification No. 0 170 000 necessitates providing a spring flap for preventing the wick to be impregnated so long as the closing cap is not removed.

While being apparently satisfying, the above arrangement still has disadvantages. In fact, the nail varnish, even when sufficiently liquid for moving by capillarity in the wick, forms successive layers on the flap which, therefore, quickly looses its tightness properties. Moreover, the varnish settles also on the spring and its proximal end, the effect of which is to modify the mechanical characteristics of the spring and therefore to be still more detrimental to the tightness properties of the flap. On the other hand, the wick is deformed by the pressure necessary for lifting the flap.

OBJECT OF THE INVENTION

This invention avoids the hereabove mentioned disadvantages.

SUMMARY OF THE INVENTION

According to the invention, the applicator device for nail varnishes and similar liquid products is placed in a container having a wick applicator wherein a neck of the container is provided with a socket-shaped support piece with a bottom portion and at least one port adjacent this bottom portion, opening and closing of the at least one port being controlled by a guidingly controllable sliding sleeve containing a wick protruding above an upper end of this sleeve.

Various other features of the invention will become more apparent from the hereafter detailed description.

BRIEF DESCRIPTION OF THE DRAWINGS

An embodiment of the invention is shown, by way of a non limiting example, in the accompanying drawings, wherein.

DETAILED DESCRIPTION OF THE INVENTION

Figure 1:
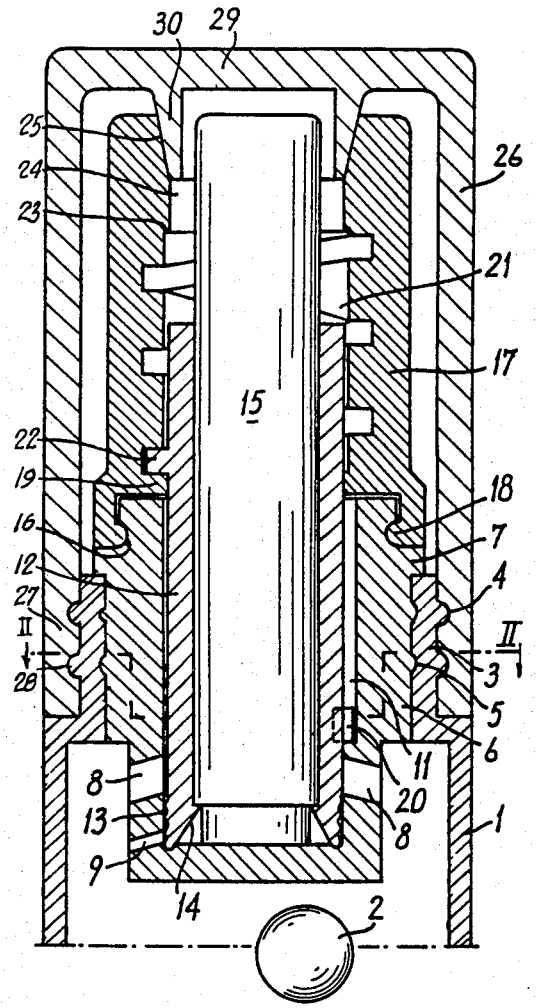
FIG. 1 is an elevation cross sectional view of the applicator device of the invention for nail varnishes and similar liquid products.

In the embodiment shown in the drawings, the applicator device comprises a container 1 of any conventional shape, containing a load of liquid product to be applied, for example a nail varnish in a diluted form.

A known mixing member, for example a ball 2, is advantageously disposed in the container 1 for causing, by a shaking action, a mixing of the constituents of the liquid product to be applied, particularly a homogenizing of the pigments of the liquid product.

The container 1 is formed at its upper portion with a neck 3 which can be made by molding when the container 1 is made of plastics material. When the container 1 is made of metal, the neck 3 is advantageously formed by shrinking. The neck 3 forms outer bulges 4, for example rings, and corresponding grooves 5 are formed on an inner wall of the neck 3.

The neck 3 is used for fixation of a socket-shaped support piece 6 having a shoulder 7 bearing on top of the neck 3.

The support piece 6 is secured against motion inside the neck 3 by protruding portions 5 forcibly engaged or fixed in any other suitable manner inside corresponding grooves in the neck 3, in order to prevent any relative displacement of the support piece 6 with respect to the container 1.

As shown in the drawings, a lower portion of the support piece 6 protrudes inside the container 1 and comprises side ports 8 as well as a bleed hole 9 formed in its lowest portion.

The support piece 6 defines an inner cavity 10, preferably of a cylindrical cross section, but which could be of a polygonal cross section. Particularly when the inner cavity 10 is of a cylindrical cross section, it is formed with at least one longitudinal slot 11.

The inner cavity 10 of the support piece 6 is used for housing the lower portion of a sleeve 12 forming a cartridge. The sleeve 12 is engaged inside the support piece 6 with a slip fit and comprises advantageously, at its lower portion, scraping segments or lips 13 the function of which is explained hereafter.

A lower portion of the sleeve 12 is opened and defines a bearing surface 14 forming a retaining element for a wick 15 made of a porous material such as a foam of synthetic resin with open cells, or in fibers or any other suitable material having capillary properties for the liquid product in the container 1.

In addition to the foregoing, the socket-shaped support piece 6 defines, in its upper portion disposed above the neck 3, a retaining groove 16 for a sheath 17 having a ring 18 forcibly engaged in the groove 16.

The sheath 17 is insidely formed with a collar 19 placed on top of the support piece 6, the collar 19 closing the upper protion of the slot or slots 11 and forming an abutment for one or several keys or ribs 20 formed on the sleeve 12.

An inner wall of the sheath 17 is formed above the collar 19 with an internal screw thread 21 having for example square threads.

A finger 22 which can form a thread segment is formed from the outer wall of the sleeve 12. The finger 22 engages the internal screw thread 21 which extends up to an inner shoulder 23 of the sheath 17.

Outer wall of the sheath 17 is smooth and is guided with a slip fit inside a nozzle 24 of the sheath 17, the nozzle 24 extending into a flared mouthpiece 25.

Moreover, the applicator device includes a cap 26 having a skirt 27 with a bottom portion formed with bulges 28 corresponding to the bulges 4 of the neck 3 and on which they can be snapped by a resilient deformation of the skirt 27.

Top portion 29 of the cap 26 is insidely formed with a conical nipple 30 which is to be applied in a tight manner against the wall of the flared mouthpiece 25.

FIG. 1 shows that the wick 15 has a longer length than the sleeve 12 forming the cartridge containing the wick 15, so that it protrudes from the top of the sleeve 12.

FIG. 1 shows the applicator device in a rest position in which the cartridge-forming sleeve 12 closes the side ports 8 as well as the bleed hole 9. It results therefrom that the liquid product which is in the container is isolated from the wick 15 and is kept away from the atmospheric air.

When the cap 26 is in place, the cap 26 covers completely the neck 3, the sheath 17 and an upper end of the wick 15. Since the conical nipple 30 is applied against the wall of the flared mouthpiece 25, there is obtained a sufficient tightness for the wick 15 to be completely isolated from the atmospheric air and, consequently, the solution with which it can be impregnated cannot evaporate. The isolation with respect to the atmosphere is further completed by the connection existing between the bottom portion of the skirt 27 and the neck 3.

When it is desired to use the applicator device, for example for spreading a nail varnish, the operator will pull out the cap 26 in order to remove it in the manner of a cork. Then, the operator will turn the sheath 17, the ring 18 of which is maintained and guided in the retaining groove 16.

Rotation of the sheath 17 has for effect to displace the finger 22 inside the internal screw thread 21 and, consequently, to lift up the sleeve 12. The motion of the sleeve 12 is linear since it is prevented from rotating due to existence of the key or keys 20 in the slot or slots 11. The same result is obtained if the sleeve 12 has, in cross section, a polygonal shape, and if the inner cavity 10 of the support piece 6 has a matching shape.

Figure 3:
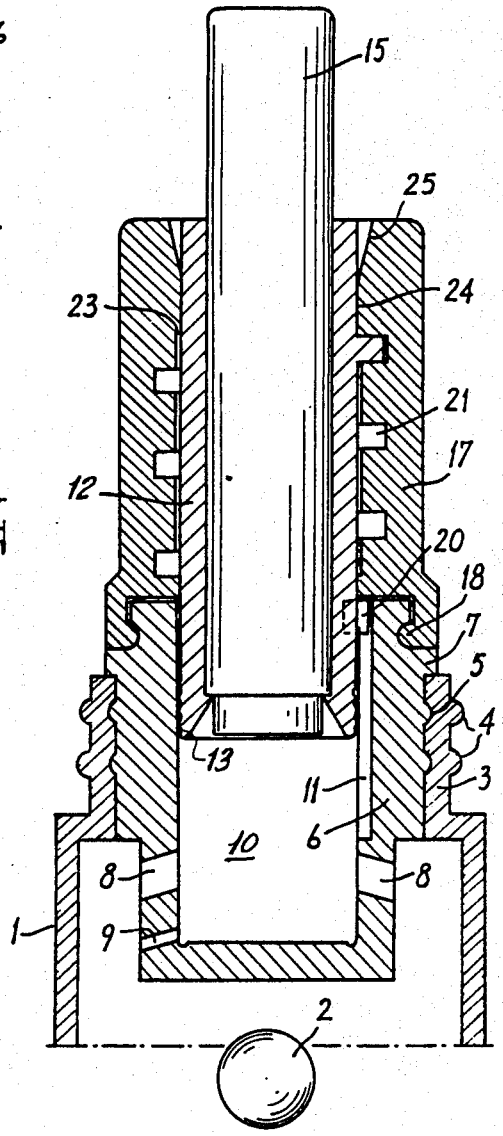
FIG. 3 is a cross sectional view similar to FIG. 1 and illustrating the applicator device in a characteristic position.
Figure 2:
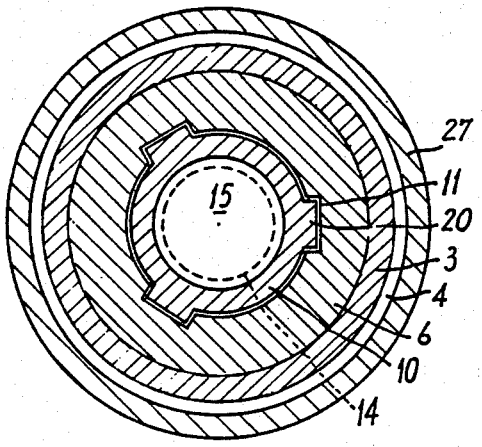
FIG. 2 is a cross sectional view substantially taken along line II—II of FIG. 1.

Effect of the displacement of the cartridge-forming 12 is to drive the wick 15 which then occupies a position shown in FIG. 3 in which the side ports 8 and bleed hole 9 are uncovered.

By tilting the container 1, the liquid product contained therein will flow through the ports 8 and into the cavity 10 of the support piece 6, and it will impregnate the wick 15 since the sleeve 12 is opened at its base. The liquid product is therefore conveyed by capillarity to the protruding end of the wick 15 and, consequently, can be applied at any desired place.

After use, the wick 15 is returned to its initial position by rotating the sheath 17 causes a sliding of the sleeve 12, the effect of which is to force back the liquid product which will still be in the inner cavity 10 when the container 1 has been returned to a substantially vertical position.

The scraping segments or lips 13 provided on the sleeve 12 thoroughly clean the inner wall of the cavity 10.

The invention is not limited to the embodiment shown and described in detail and various modifications can be carried out thereto without departing from its scope as shown in the accompanying claims.

I claim:

1. An applicator device for nail varnishes and similar liquid products placed in a container having a neck at an exit end thereof, said device comprising:

a socket-shaped support piece fit in an air tight manner within the neck and having a bottom portion extending into the container, at least one port adjacent said bottom portion which communicates an inner cavity of said support piece with the container and a longitudinal slot defined in an inner surface thereof;

a sliding sleeve slideably disposed within the inner cavity of said support piece for selectively opening and closing said at least one port and containing a wick having a first end adapted to extend into the inner cavity and a second end which protrudes above an upper end of said sleeve, an outer surface of said sleeve including at least one finger segment extending therefrom and at least one key extending therefrom adapted to slide longitudinally along the slot in the inner surface of said support piece for axially guiding said sleeve;

a sheath rotatably mounted on an upper end of said support piece for controlling the sliding motion of said sleeve, said sheath including an internal screw thread on an inner surface thereof for receiving said at least one key such that when said sheath is rotated, said sleeve is axially guided by engagement of said at least one key in said internal screw thread; and wherein said sleeve is slideably moveable between a withdrawn position in which said at least one port is closed in an air tight manner by said sleeve and an extended position in which said at least one port is opened and the liquid product can flow from the container into the inner cavity to be brought into contact with the wick.

2. The device as set forth in claim 1, wherein said sleeve is opened at a lower portion thereof, said lower portion defining a bearing surface for the first end of the wick.

3. The device as set forth in claim 1, wherein said socket-shaped support piece further comprises a bleed hole formed at a bottom end thereof and said sleeve comprises scraping segments disposed at least at a lower portion of the sleeve which extend from a surface of said sleeve in the vicinity of said bleed hole for scraping excess liquid product from said support piece.

4. the device as set forth in claim 1, wherein said socket-shaped support piece is rigidly fixed inside said container.

5. The device as set forth in claim 1, wherein said sheath defines a guiding nozzle near an upper portion of said sheath extended by a flared mouthpiece having inclined walls, and wherein said device further comprises a cap having a conical nipple extending inside said cap, said nipple having walls adapted to cooperate with said inclined walls of said mouthpiece to tightly close the device.

6. The device as set forth in claim 5, wherein said cap comprises resilient deformation means for maintaining said cap on the neck.

7. The device as set forth in claim 6, wherein said resilient deformation means comprises outwardly protruding bulges provided on an external surface of the neck and corresponding grooves provided on an inner surface of said cap wherein said bulges are adapted to be snapped on to said grooves by resilient deformation of said cap.

8. The device as set forth in claim 1, wherein said support piece comprises a groove formed on an upper portion thereof, said sheath comprises a collar and a ring provided on a lower portion thereof and said sheath bears against the upper portion of the support piece by the collar and the ring forcibly engaging inside the groove of the support piece.

9. The device as set forth in claim 8, wherein said collar forms an abutment for said at least one finger segment whereby said finger segment is prevented from further axial travel by engagement with said collar.

10. The device as set forth in claim 1, wherein said support piece comprises protruding bulges provided on an outer surface thereof and the neck comprises grooves corresponding to said protruding bulges and wherein said support piece is tightly fit within the neck by engagement of the bulges with the grooves.

* * * * *